US006162353A

United States Patent [19]

Wu et al.

[11] Patent Number: 6,162,353

[45] **Date of Patent: *Dec. 19, 2000**

[54] PROCESS AND CATALYST FOR UPGRADING LIQUID HYDROCARBONS

[75] Inventors: An-hsiang Wu; Ralph J. Melton, both of Bartlesville; Charles A. Drake, Nowata, all of Okla.

[73] Assignee: Phillips Petroleum Company, Bartlesville, Okla.

[ * ] Notice: This patent issued on a continued prosecution application filed under 37 CFR 1.53(d), and is subject to the twenty year patent term provisions of 35 U.S.C. 154(a)(2).

[21] Appl. No.: 09/469,202

[22] Filed: Dec. 21, 1999

[51] Int. Cl.[7] ..... C10G 45/04

[52] U.S. Cl. ..... 208/216 R; 208/213; 502/60; 502/64; 502/71

[58] Field of Search ..... 208/213, 216 R; 502/60, 64, 71

[56] References Cited

U.S. PATENT DOCUMENTS

| | | | |
|---|---|---|---|
| 3,849,290 | 11/1974 | Wise et al. | 208/66 |
| 3,926,782 | 12/1975 | Plank et al. | 208/135 |
| 5,482,617 | 1/1996 | Collins et al. | 208/227 |
| 5,981,418 | 11/1999 | Drake et al. | 502/64 |
| 6,051,520 | 4/2000 | Wu et al. | 502/60 |
| 6,077,984 | 6/2000 | Drake et al. | 585/418 |

OTHER PUBLICATIONS

Application Serial No. 09/114,991 filed on Jul. 14, 1998.
Application Serial No. 09/221,814 filed on Dec. 29, 1998, allowed on Mar. 27, 2000.
Application Serial No. 09/469,038 filed on Dec. 21, 1999.
Application Serial No. 09/467,860 filed on Dec. 20, 1999.

*Primary Examiner*—Tom Dunn
*Attorney, Agent, or Firm*—Jeffrey R. Anderson

[57] ABSTRACT

An improved process and novel catalyst for upgrading catalytically cracked liquid hydrocarbons whereby the hydrodesulfurization and liquid yield of the hydrocarbons are enhanced while the octane number thereof is substantially maintained. The process basically comprises contacting the hydrocarbons with the catalyst composition which is comprised of a sulfided, molybdenum carbide and zinc hexaborate promoted, binder bound zeolite in the presence of hydrogen and under conditions sufficient to effect said upgrading.

35 Claims, No Drawings

PROCESS AND CATALYST FOR UPGRADING LIQUID HYDROCARBONS

BACKGROUND OF THE INVENTION

1. Field of the Invention

The present invention relates to an improved process and a novel catalyst composition for upgrading catalytically cracked liquid hydrocarbons containing sulfur impurities, olefinic components and other unsaturated components.

2. Description of the Prior Art

Catalytically cracked liquid hydrocarbons boiling in the gasoline range often contain substantial proportions of sulfur impurities. Such sulfur impurities require removal, usually by hydrotreating, in order to comply with products specifications and/or to comply with environmental regulations. The forthcoming environmental regulations established by the Clean Air Act (complex model) will require gasoline to have more stringent low levels of sulfur impurities.

While hydrodesulfurization processes and catalysts are commonly utilized to remove sulfur impurities from catalytically cracked liquid hydrocarbons, the hydrotreatment also causes a reduction in the olefin and other unsaturated hydrocarbon content of the liquid hydrocarbons which in turn reduces the octane number thereof. As the degree of desulfurization increases, the octane number of the catalytically cracked liquid hydrocarbons decreases. In addition, the use of a hydrodesulfurization process to remove sulfur impurities from catalytically cracked liquid hydrocarbons significantly reduces the volume of the liquid hydrocarbons remaining after the treatment.

Thus, there are needs for improved processes and/or catalysts for upgrading catalytically cracked liquid hydrocarbons whereby the hydrodesulfurization and liquid yield of the liquid hydrocarbons are enhanced as compared to prior processes while the octane number of the upgraded liquid hydrocarbons is substantially maintained.

SUMMARY OF THE INVENTION

The present invention provides an improved process and a novel catalyst composition for upgrading catalytically cracked liquid hydrocarbons which meet the needs described above and overcome the deficiencies of the prior art. The improved process of this invention for upgrading catalytically cracked liquid hydrocarbons is comprised of the steps of contacting the liquid hydrocarbons with a catalyst composition comprising a sulfided, molybdenum carbide and zinc hexaborate promoted, binder bound zeolite in the presence of hydrogen and under conditions sufficient to effect the upgrading.

The process conditions referred to above generally comprise a temperature in the range of from about 200° C. to about 800° C., a pressure in the range of from subatmospheric to about 1,000 psia, a hydrogen flow rate such that the hydrogen to feedstock molar ratio is in the range of from about 1:1 to about 30:1 and a weight hourly space velocity in the range of from about 0.01 hour$^{-1}$ to about 1,000 hour$^{-1}$.

The novel catalyst composition of the present invention is comprised of a sulfided, molybdenum carbide and zinc hexaborate promoted, binder bound zeolite and is prepared by combining zeolite, molybdenum oxide and zinc hexaborate with the binder used, preferably aluminum oxide, in a manner to produce a mixture thereof. The mixture is calcined and then contacted with a mixture of methane and hydrogen under conditions and for a time sufficient to produce molybdenum carbide in the calcined mixture.

Thereafter, the zeolite, molybdenum carbide, zinc hexaborate and binder mixture is contacted with carbon disulfide and hydrogen under conditions and for a time sufficient to incorporate sulfide in the mixture.

Thus, it is a general object of the present invention to provide an improved process and novel catalyst composition for upgrading catalytically cracked hydrocarbons.

Other and further objects, features and advantages of the present invention will be readily apparent to those skilled in the art upon a reading of the description of preferred embodiments which follows.

DESCRIPTION OF PREFERRED EMBODIMENTS

It is well known that prior art processes and catalysts used therein involving hydrodesulfurization of catalytically cracked liquid hydrocarbons successfully remove sulfur impurities, but cause a corresponding reduction in unsaturated hydrocarbon content and a reduction in liquid yield. As compared to the prior art processes, the improved process and catalyst composition of the present invention for upgrading catalytically cracked liquid hydrocarbons brings about enhanced hydrodesulfurization and liquid yield while substantially maintaining the unsaturated hydrocarbon content, i.e., the octane number, of the liquid hydrocarbons.

The improved process of the present invention basically comprises contacting catalytically cracked liquid hydrocarbons with a novel catalyst composition in the presence of hydrogen and under conditions sufficient to effect the upgrading of the liquid hydrocarbons. The term "upgrading" is used herein to mean the removal of sulfur impurities from the liquid hydrocarbons to an acceptable level. The process of this invention is particularly suitable for upgrading catalytically cracked gasoline. The term "catalytically cracked gasoline" as used herein refers to the 65° F.–430° F. hydrocarbon fraction obtained by catalytic cracking. This hydrocarbon fraction generally includes a high sulfur impurity content and contains a significant concentration of olefins.

The step of contacting the catalytically cracked liquid hydrocarbons with the catalyst composition is carried out in a reaction zone containing the catalyst composition, and under hydrodesulfurization reaction conditions that suitably bring about the removal of sulfur impurities from the liquid hydrocarbons. The reaction temperature is generally in the range of from about 200° C. to about 800° C., more preferably from about 200° C. to about 700° C., and most preferably, from 250° C. to 600° C. The pressure is generally in a range from subatmospheric to about 1,000 psia, more preferably from about 200 psia to about 800 psia, and most preferably, from 300 psia to 700 psia. The flow rate of hydrogen into the reaction zone is such that the hydrogen to feedstock mole ratio is in the range of from about 1:1 to about 30:1, more preferably from about 1:1 to about 20:1 and most preferably from 2:1 to 10:1. The flow rate at which the catalytically cracked liquid hydrocarbons are charged to the reaction zone is that flow rate which provides a weight hourly space velocity (WHSV) in the range of from about 0.01 hour$^{-1}$ to about 1,000 hour$^{-1}$. The term "weight hourly space velocity" as used herein means the numerical ratio of the rate at which the catalytically cracked liquid hydrocarbon feedstock is charged to the reaction zone in pounds per hour divided by the pounds of catalyst composition contained in the reaction zone to which the liquid hydrocarbons are charged. A more preferred WHSV of the feedstock to the reaction zone is in the range of from about 0.25 hour$^{-1}$ to about 250 hour$^{-1}$ and most preferably, from 0.5 hour$^{-1}$ to 100 hour$^{-1}$. The reaction zone of the present invention can be one or more single pass fixed catalyst beds, a batch type reactor or a fluidized type reactor.

The novel catalyst composition employed in the process of the present invention is a sulfided, molybdenum carbide and zinc hexaborate promoted, binder bound zeolite.

Typical zeolites that can be utilized in accordance with this invention include, but are not limited to, those designated as ZSM-5, ZSM-8, ZSM-11, ZSM-12, ZSM-35, ZSM-38, ZSM-4, BEA, Y, MOR, FER and MAZ. Of these, ZSM-5 zeolite is preferred and HZSM-5 zeolite is most preferred. ZSM-5 zeolite is an ultra stable synthetic siliceous crystalline material which is particularly suitable for carrying out hydrocarbon conversion processes. ZSM-5 zeolite and its method of preparation are described in U.S. Pat. No. 3,702,886 issued to Argauer et al. on Nov. 14, 1972, which is incorporated herein by reference. The preferred HZSM-5 zeolite is prepared from ZSM-5 zeolite by a procedure which includes ammonium/hydrogen exchange.

A variety of binders have been used with zeolite and are well known to those skilled in the art. Examples of such binders include, but are not limited to, clays, aluminum oxide, silicas, alumina-silica, aluminum phosphate, aluminum chlorohydrate and the like. Aluminum oxide is preferred for use in accordance with the present invention.

The sulfided, molybdenum carbide and zinc hexaborate promoted, alumina bound zeolite catalyst composition of this invention is prepared as follows. A mixture of the zeolite, molybdenum oxide, zinc hexaborate and aluminum oxide is calcined in air. The resulting calcined mixture is then contacted with a mixture of methane and hydrogen under conditions and for a time sufficient to produce molybdenum carbide in the calcined mixture. Thereafter, the zeolite, molybdenum carbide, zinc hexaborate and alumina mixture is contacted with a mixture of carbon disulfide and hydrogen under conditions and for a time sufficient to incorporate sulfide in the mixture.

The initial mixing of the zeolite, molybdenum oxide, zinc hexaborate and alumina binder is preferably performed with sufficient deionized water to form an extrudable paste. The paste is then auger extruded and the extrudate is dried. The calcining of the extrudate is conducted in air at a temperature in the range of from about 300° C. to about 1,000° C., preferably from about 350° C. to about 750° C. and most preferably from 450° C. to 650° C.; at a pressure in the range of from about 0 psia to about 740 psia, more preferably from about 10 psia to about 440 psia and most preferably from 20 psia to 150 psia; and for a time period in the range of from about 0.1 hour to about 30 hours, more preferably from about 2 hours to about 20 hours and most preferably from 3 hours to 15 hours.

The calcined mixture is contacted with the mixture of methane and hydrogen at a temperature in the range of from about 550° C. to about 750° C., more preferably from about 575° C. to about 725° C. and most preferably from 600° C. to 700° C.; at a pressure in the range of from about 0 psia to about 740 psia, more preferably from about 10 psia to about 440 psia and most preferably from 20 psia to 150 psia; and for a time period in the range of from about 0.1 hour to about 30 hours, more preferably from about 2 hours to about 20 hours and most preferably from 3 hours to 15 hours.

The final step of sulfiding the catalyst with a mixture of carbon disulfide and hydrogen is carried out at a temperature in the range of from about 200° C. to about 600° C., more preferably from about 250° C. to about 550° C. and most preferably from 300° C. to 500° C.; at a pressure in the range of from about 0 psia to about 740 psia more preferably from about 10 psia to about 440 psia and most preferably from 20 psia to 150 psia; and for a time period in the range of from about 0.1 hour to about 30 hours, more preferably from about 2 hours to about 20 hours and most preferably from 3 hours to 15 hours.

The quantities of the various components of the catalyst are such that the concentration of the zeolite in the catalyst composition is in the range of from about 1% to about 99% by weight of the catalyst composition, more preferably from about 5% to about 50% and most preferably from 10% to 40%. The concentration of the molybdenum carbide in the catalyst composition is generally in the range of from about 1% to about 99% by weight of the catalyst composition, more preferably from about 2% to about 60% and most preferably from 5% to 50%. The concentration of the zinc hexaborate in the catalyst composition is in the range of from about 1% to about 99% by weight of the catalyst composition, more preferably from about 2% to about 50% and most preferably from 3% to 25%. The concentration of the alumina binder in the catalyst composition is preferably in the range of from about 1% to about 99% by weight of the catalyst composition, more preferably from about 5% to about 50% and most preferably from 10% to 40%.

Thus, the improved process for upgrading catalytically cracked liquid hydrocarbons whereby the hydrodesulfurization and liquid yield of the liquid hydrocarbons are enhanced while the octane number thereof is substantially maintained is basically comprised of the step of contacting the liquid hydrocarbons with a catalyst composition in the presence of hydrogen and under conditions sufficient to effect the upgrading wherein the catalyst composition comprises a sulfided, molybdenum carbide and zinc hexaborate promoted, binder bound zeolite.

The catalyst composition of this invention is prepared by the steps comprising: (a) combining zeolite, molybdenum oxide and zinc hexaborate with a binder in a manner to produce a mixture thereof; (b) calcining the zeolite, molybdenum oxide, zinc hexaborate and binder mixture produced in step (a); (c) contacting the calcined mixture produced in step (b) with a mixture of methane and hydrogen under conditions and for a time sufficient to produce molybdenum carbide in said calcined mixture; and (d) contacting the zeolite, molybdenum carbide, zinc hexaborate and binder mixture produced in step (c) with a mixture of carbon disulfide and hydrogen under conditions and for a time sufficient to incorporate sulfide in the mixture.

In order to further illustrate the process and catalyst of the present invention, the following examples are given.

EXAMPLE 1

A number of different catalyst compositions containing molybdenum compounds were prepared as follows.

Catalyst A was prepared by mixing 15 grams of molybdenum oxide and 25 grams of aluminum oxide with sufficient deionized water to form an extrudable paste. The mixture was auger extruded to 1/16" cylindrically shaped extrudates which were dried at 120° C. The extrudates were then calcined in air at 538° C. for 6 hours to form a catalyst containing 30.77% by weight molybdenum.

Catalyst B was prepared by contacting 22.36 grams of Catalyst A with a mixture of 1 part by volume methane and 4 parts by volume hydrogen at a flow rate of 750 milliliters per minute and a temperature of 700° C. for 2 hours. 20.96 grams of catalyst containing 66% by weight molybdenum carbide was produced.

Catalyst C was prepared by mixing 10 grams of an HZSM-5 zeolite obtained from Uetikon having a trade designation of "ZEOCAT™" PZ2/50H (obtained as a powder), 5 grams of molybdenum oxide and 12 grams of aluminum oxide binder with sufficient deionized water to form an extrudable paste. The mixture was auger extruded to 1/16" cylindrically shaped extrudate and dried at 120° C. The extrudates were then calcined in air at 538° C. for 6 hours. The resulting 22.77 grams of the calcined extrudates were contacted with a mixture of 1 part by volume methane and 4 parts by volume hydrogen at a flow rate of 700 milliliters per minute at a temperature of 700° C. and for a time period of 2 hours thereby producing 19.88 grams of molybdenum carbide promoted, aluminum bound HZSM-5 zeolite catalyst.

Catalyst D was prepared by mixing 10 grams of the above described HZSM-5 zeolite, 5 grams of molybdenum oxide, 1 gram of zinc hexaborate and 12 grams of alumina binder with sufficient deionized water to form an extrudable paste. The mixture was auger extruded to 1/16" cylindrically shaped extrudates and the extrudates were dried at 120° C. The extrudates were then calcined at 538° C. for 6 hours. 21.24 grams of the calcined extrudates were contacted with a mixture of 1 part by volume methane and 4 parts by volume hydrogen at a rate of 700 milliliters per minute at a temperature of 700° C. for 2 hours to produce 19.59 grams of molybdenum carbide and zinc hexaborate promoted, alumina bound HZSM-5 zeolite catalyst.

Catalyst E was prepared by contacting 14.06 grams of above described Catalyst C with hydrogen at a flow rate of 100 milliliters per minute and carbon disulfide at 400° C. for 2 hours to produce 14.88 grams of sulfided molybdenum carbide promoted, alumina bound HZSM-5 zeolite catalyst.

Catalyst F (the catalyst of the present invention) was prepared by contacting 16.7 grams of Catalyst D described above with hydrogen at a flow rate of 100 milliliters per minute and carbon disulfide at 400° C. for 2 hours to produce 17 grams of sulfided, molybdenum carbide and zinc hexaborate promoted, alumina bound HZSM-5 zeolite catalyst.

EXAMPLE 2

This example illustrates the use of the various catalyst compositions described in Example 1 above in the upgrading of catalytically cracked gasoline (CCG).

Each of the catalyst compositions was tested using a quartz reactor tube (1 centimeter inside diameter×60 centimeters long) filled with a 20 centimeter bottom layer of "ALUNDUM®" alumina (inert, low surface area alumina), the catalyst composition tested in the amount given in the Table below and a 20 centimeter top layer of alumina. The liquid feed was a catalytically cracked gasoline obtained from Phillips Petroleum Company, Bartlesville, Okla., which had a density of 0.742 and a molecular weight of 80. The catalytically cracked gasoline contained sulfur in an amount of 298 parts per million by weight, paraffins in an amount of 4.3 weight percent, isoparaffins in an amount of 26.424 weight percent, aromatics in an amount of 31.902 weight percent, naphthalene in an amount of 8.243 weight percent and olefins in an amount of 26.995 weight percent. The octane number of the catalytically cracked gasoline was 89.20. The feed rate of the gasoline into the reactor was 20 ml/hour. The reactor effluent was cooled and separated into a gaseous phase and a liquid phase. The liquid phase was analyzed by a gas chromatograph at intervals of about 1 hour. The conditions of the runs using the various catalyst compositions described in Example 1 above as well as the results of the runs at about 6 hours each are given in the Table below.

TABLE

Catalytically Cracked Gasoline Upgrade Using Various Catalyst Compositions

| Catalyst Composition | Catalyst Amount grams | Run Time, hr. | Reactor Temp., ° C. | Reactor Pressure, psi | WHSV[1] $hour^{-1}$ | RT[2], sec. | $H_2$ Rate, liters/hr. | $H_2$/CCG, mole ratio | Upgraded CCG Yield, % by weight | Calculated Octane Number | Sulfur Content, PPMW | Wt. % HDS[3] |
|---|---|---|---|---|---|---|---|---|---|---|---|---|
| A | 3.39 | 5.58 | 356 | 492 | 4.497 | 8.664 | 15.6 | 3.779 | 76.65 | 83.58 | 9 | 96.98 |
| B | 2.94 | 5.85 | 346 | 520 | 5.048 | 8.146 | 15.6 | 3.779 | 82.96 | 83.38 | 3.5 | 98.83 |
| C | 2.56 | 5.87 | 349 | 492 | 5.797 | 6.721 | 15.6 | 3.779 | 70.05 | 86.35 | 15 | 94.97 |
| D | 2.39 | 5.97 | 355 | 520 | 6.209 | 6.622 | 15.6 | 3.779 | 73.40 | 88.04 | 12 | 95.97 |
| E | 2.63 | 6.15 | 351 | 498 | 5.643 | 6.987 | 15.6 | 3.779 | 71.29 | 88.07 | 7 | 97.65 |
| F (inventive) | 2.47 | 6.67 | 351 | 500 | 6.008 | 6.587 | 15.6 | 3.779 | 77.44 | 88.41 | 9 | 96.98 |

[1]Weight Hourly Space Velocity
[2]RT means residence time
[3]HDS means hydroesulfurization From the Table it can be seen that the sulfided, molybdenum carbide and zinc hexaborate promoted, alumina bound HZSM-5 zeolite catalyst of the present invention (Catalyst F) achieved the best result of the various catalysts tested. More importantly, the catalyst of this invention produced enhanced hydrodesulfurization and liquid yield while substantially maintaining the octane number of the feed stream.

Thus, the process of the present invention is well adapted to carry out the objects and attain the ends and advantages mentioned as well as those which are inherent therein.

While numerous changes may be made by those skilled in the art, such changes are encompassed within the spirit of this invention as defined by the appended claims.

What is claimed is:

1. An improved process for upgrading catalytically cracked liquid hydrocarbons whereby the hydrodesulfurization and liquid yield of the hydrocarbons are enhanced while the octane number thereof is substantially maintained comprising contacting said hydrocarbons with a catalyst composition in the presence of hydrogen and under conditions sufficient to effect said upgrading wherein said catalyst composition comprises a sulfided, molybdenum carbide and zinc hexaborate promoted, binder bound zeolite.

2. The process of claim 1 wherein said catalytically cracked liquid hydrocarbons comprise the 65° F.–430° F. hydrocarbon fraction produced from heavier hydrocarbon fractions containing sulfur and olefins.

3. The process of claim 1 wherein said conditions comprise a temperature in the range of from about 200° C. to about 800° C., a pressure in the range of from subatmospheric to about 1,000 psia, a hydrogen flow rate such that the hydrogen to feedstock mole ratio is in the range of from about 1:1 to about 30:1 and a weight hourly space velocity in the range of from about 0.01 $hour^{-1}$ to about 1,000 $hour^{-1}$.

4. The process of claim 1 wherein said conditions comprise a temperature of from 250° C. to 600° C., a pressure of from 300 psia to 700 psia, a hydrogen flow rate such that the hydrogen to feedstock mole ratio is from 2:1 to 10:1 and a weight hourly space velocity of from 0.5 $hour^{-1}$ to 100 $hour^{-1}$.

5. The process of claim 1 wherein said zeolite is HZSM-5 zeolite.

6. The process of claim 1 wherein said binder is aluminum oxide.

7. The process of claim 1 wherein the concentration of said zeolite in said catalyst composition is in the range of from about 1% to about 99% by weight of said catalyst composition.

8. The process of claim 1 wherein the concentration of said molybdenum carbide in said catalyst composition is in the range of from about 1% to about 99% by weight of said catalyst composition.

9. The process of claim 1 wherein the concentration of said zinc hexaborate in said catalyst composition is in the range of from about 1% to about 99% by weight of said catalyst composition.

10. The process of claim 1 wherein said catalyst composition is prepared by the steps comprising:

(a) combining zeolite, molybdenum oxide and zinc hexaborate with said binder in a manner to produce a mixture thereof:

(b) calcining the zeolite, molybdenum oxide, zinc hexaborate and binder mixture produced in step (a);

(c) contacting the calcined mixture produced in step (b) with a mixture of methane and hydrogen under conditions and for a time sufficient to produce molybdenum carbide in said calcined mixture; and (d) contacting the zeolite, molybdenum carbide, zinc hexaborate and binder mixture produced in step (c) with carbon disulfide and hydrogen under conditions and for a time sufficient to incorporate sulfide in said mixture.

11. The process of claim 9 wherein said zeolite, molybdenum oxide, zinc hexaborate and binder mixture is calcined in step (b) in air at a temperature in the range of from about 300° C. to about 1,000° C., at a pressure in the range from about 0 psia to about 740 psia and for a time period in the range of from about 0.1 hour to about 30 hours.

12. The process of claim 9 wherein said calcined mixture is contacted with said mixture of methane and hydrogen in accordance with step (c) at a temperature in the range of from about 550° C. to about 750° C., a pressure in the range of from about 0 psia to about 740 psia and for a time period in the range of from about 0.1 hour to about 30 hours.

13. The process of claim 9 wherein said zeolite, molybdenum carbide, zinc hexaborate and binder mixture is contacted with said carbon disulfide and hydrogen in accordance with step (d) at a temperature in the range of from about 200° C. to about 600° C., at a pressure in the range of from about 0 psia to about 740 psia and for a time period in the range of from about 0.1 hour to about 30 hours.

14. An improved process for upgrading catalytically cracked gasoline whereby the hydrodesulfurization and liquid yield of the gasoline are enhanced while the octane number thereof is substantially maintained comprising contacting said gasoline with a sulfided, molybdenum carbide and zinc hexaborate promoted, alumina bound zeolite catalyst composition in the presence of hydrogen and under conditions sufficient to effect said upgrading, wherein said catalyst composition is produced by the steps of:

(a) combining the zeolite, molybdenum oxide and zinc hexaborate with an aluminum oxide binder in a manner to produce a mixture thereof;

(b) calcining said mixture produced in step (a) in air;

(c) contacting the calcined mixture produced in step (b) with a mixture of methane and hydrogen under conditions and for a time sufficient to produce, molybdenum carbide in said calcined mixture; and (d) contacting the mixture produced in step (c) with carbon disulfide and hydrogen under conditions and for a time sufficient to incorporate sulfide in said mixture.

15. The process of claim 14 wherein said zeolite is HZSM-5 zeolite.

16. The process of claim 14 wherein said catalytically cracked gasoline comprises the 65° F.–430° F. hydrocarbon fraction produced from heavier hydrocarbon fractions containing sulfur and olefins.

17. The process of claim 14 wherein said conditions sufficient to effect said upgrading comprise a temperature in the range of from about 200° C. to about 800° C., a pressure in the range of from superatmospheric to about 1,000 psia, a hydrogen flow rate such that the hydrogen to feedstock mole ratio is from 1:1 to 30:1 and a weight hourly space velocity in the range of from about 0.01 $hour^{-1}$ to about 1,000 $hour^{-1}$.

18. The process of claim 14 wherein said zeolite is HZMS-5 zeolite.

19. The process of claim 14 wherein the concentration of said HZMS-5 zeolite in said catalyst composition is in the range of from about 5% to about 50% by weight of said catalyst composition.

20. The process of claim 14 wherein the concentration of said molybdenum carbide in said catalyst composition is in the range of from about 2% to about 60% by weight of said catalyst composition.

21. The process of claim 14 wherein the concentration of said zinc hexaborate in said catalyst composition is in the range of from about 2% to about 50% by weight of said catalyst composition.

22. The process of claim 14 wherein said zeolite, molybdenum oxide, zinc hexaborate and aluminum oxide mixture is calcined in accordance with step (b) at a temperature of from 350° C. to 750° C., at a pressure of from 10 psia to 440 psia and for a time period of from 2 hours to 20 hours.

23. The process of claim 14 wherein said calcined mixture is contacted with said mixture of methane and hydrogen in accordance with step (c) at a temperature of from 575° C. to 725° C., at a pressure of from 10 psia to 440 psia and for a time period of from 2 hours to 20 hours.

24. The process of claim 14 wherein said mixture produced in step (c) is contacted with said carbon disulfide and hydrogen in accordance with step (d) at a temperature of from 250° C. to 550° C. at a pressure of from 10 psia to 440 psia and for a time period of from 2 hours to 20 hours.

25. A catalyst composition comprised of a sulfided, molybdenum carbide and zinc hexaborate promoted, binder bound zeolite.

26. The catalyst composition of claim 25 wherein said zeolite is HZSM-5 zeolite.

27. The catalyst composition of claim 25 wherein said binder is aluminum oxide.

28. The catalyst composition of claim 25 which is prepared by:

(a) combining the zeolite, molybdenum oxide and zinc hexaborate with an aluminum oxide binder in a manner to produce a mixture thereof;

(b) calcining said mixture produced in step (a) in air;

(c) contacting the calcined mixture produced in step (b) with a mixture of methane and hydrogen under conditions and for a time sufficient to produce, molybdenum carbide in said calcined mixture; and (d) contacting the mixture produced in step (c) with carbon disulfide and hydrogen under conditions and for a time sufficient to incorporate sulfide in said mixture.

29. The catalyst composition of claim 25 wherein the concentration of said HZMS-5 zeolite in said catalyst composition is in the range of from about 5% to about 50% by weight of said catalyst composition.

30. The catalyst composition of claim 25 wherein the concentration of said molybdenum carbide in said catalyst composition is in the range of from about 2% to about 60% by weight of said catalyst composition.

31. The catalyst composition of claim 25 wherein the concentration of said zinc hexaborate in said catalyst composition is in the range of from about 2% to about 50% by weight of said catalyst composition.

32. The catalyst composition of claim 25 wherein the concentration of said alumina binder in said catalyst composition is in the range of from about 5% to about 50% by weight of said catalyst composition.

33. The catalyst composition of claim 28 wherein said zeolite, molybdenum oxide, zinc hexaborate and aluminum oxide mixture is calcined in accordance with step (b) at a temperature of from 350° C. to 750° C., at a pressure of from 10 psia to 440 psia and for a time period of from 2 hours to 20 hours.

34. The catalyst composition of claim 28 wherein said calcined mixture is contacted with said mixture of methane and hydrogen in accordance with step (c) at a temperature of from 575° C. to 725° C., at a pressure of from 10 psia to 440 psia and for a time period of from 2 hours to 20 hours.

35. The catalyst composition of claim 28 wherein said mixture produced in step (c) is contacted with said carbon disulfide and hydrogen in accordance with step (d) at a temperature of from 250° C. to 550° C. at a pressure of from 10 psia to 440 psia and for a time period of from 2 hours to 20 hours.

* * * * *